US008965262B2

(12) United States Patent
Muramatsu

(10) Patent No.: US 8,965,262 B2
(45) Date of Patent: Feb. 24, 2015

(54) FIXING MEMBER, METHOD OF PRODUCING FIXING MEMBER, AND FIXING DEVICE

(71) Applicant: Canon Kabushiki Kaisha, Tokyo (JP)

(72) Inventor: Hiroki Muramatsu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/090,253

(22) Filed: Nov. 26, 2013

(65) Prior Publication Data

US 2014/0153986 A1 Jun. 5, 2014

(30) Foreign Application Priority Data

Nov. 30, 2012 (JP) ..... 2012-263252

(51) Int. Cl.
*G03G 15/20* (2006.01)

(52) U.S. Cl.
CPC ..... *G03G 15/2057* (2013.01)
USPC ..... 399/333; 399/176; 399/335; 399/329; 399/357

(58) Field of Classification Search
USPC ..... 399/176, 335, 329, 333, 357
See application file for complete search history.

(56) References Cited

U.S. PATENT DOCUMENTS 7,452,594 B2 * 11/2008 Pickering ..... 428/323
2012/0298273 A1 * 11/2012 Cotugno et al. ..... 152/510

FOREIGN PATENT DOCUMENTS

JP 2004-101970 A 4/2004
JP 2007-304374 A 11/2007

* cited by examiner

*Primary Examiner* — Walter L Lindsay, Jr.
*Assistant Examiner* — Roy Y Yi
(74) *Attorney, Agent, or Firm* — Canon U.S.A. Inc., IP Division

(57) ABSTRACT

When filler particles are added to a surface layer of a fixing member in order to enhance a toner releasing property, if the filler particles are randomly oriented, chemical affinity between the surface layer of the fixing member and toner is enhanced and a sufficient effect cannot be accomplished. Therefore, whisker-shaped filler particles are added to the surface layer of the fixing member, and the filler particles are oriented to approximately follow a rotation direction of the fixing member.

15 Claims, 13 Drawing Sheets

FIXING MEMBER, METHOD OF PRODUCING FIXING MEMBER, AND FIXING DEVICE

BACKGROUND OF THE INVENTION

1. Field of the Invention

The present invention relates to a fixing member, a method of producing the fixing member, and a fixing device. This fixing member is used for fixing a toner image on a sheet in a copying machine, a printer, a facsimile machine, and a multifunction peripheral (MFP) comprising a plurality of these functions.

2. Description of the Related Art

Conventionally, a fixing device by which a toner image is fixed on a sheet (recording material) by heating and pressurizing the sheet on which the toner image has been formed has been employed in image forming apparatuses such as copying machines and the like. For the purpose of enhancing a function of the fixing member used in such a fixing device, it has been proposed to devise a surface layer of the fixing member.

In Japanese Patent Application Laid-Open No. 2004-101970, for the purpose of preventing toner from transferring from the sheet to the fixing member (enhancing a toner releasing property), it has been proposed that many grooves along its lengthwise direction are formed in a circumferential direction on the surface layer of the fixing member.

However, in the technique described in Japanese Patent Application Laid-Open No. 2004-101970, the surface layer of the fixing member is ground down and an initial groove shape cannot be kept as fixing processing is repeatedly performed. Consequently, it becomes difficult to keep the toner releasing property over a long period of time.

Thus, adding filler particles to the surface layer of the fixing member may be conceivable. In Japanese Patent Application Laid-Open No. 2007-304374, although the purpose is not enhancing the toner releasing property but enhancing a heat conductivity of the fixing member, it has been proposed that carbon nanotubes or carbon nanofibers is added as a filler to the surface layer of the fixing member.

However, when a whisker-shaped (rod-shaped) filler is added to the surface layer of the fixing member as described in Japanese Patent Application Laid-Open No. 2007-304374, the present inventor has found that a problem may occur depending on how to add it (orientation of the filler).

In detail, it is not specifically described how to add the filler in Japanese Patent Application Laid-Open No. 2007-304374, but the present inventor has found that, for example, when the filler is randomly oriented, it is likely to occur that a chemical affinity between the surface layer of the fixing member and the toner is increased and the toner releasing property is lowered.

Therefore, when the filler is randomly oriented in the surface layer of the fixing member, an amount of the toner that transfers from the sheet to the fixing member may be increased and an image quality may be decreased.

As described above, when the whisker-shaped (rod-shaped) filler is added to the surface layer of the fixing member, it becomes difficult to enhance the toner releasing property, depending on how to orient the filler.

SUMMARY OF THE INVENTION

The present invention is directed to a fixing member that can enhance a toner releasing property, a method of producing the fixing member, and a fixing device.

The present invention is further directed to a fixing member that can prevent quality loss of an image even in the use of the fixing member over a long period of time, a method of producing the fixing member, and a fixing device.

Further features of the present invention will become apparent from the following description of exemplary embodiments with reference to the attached drawings.

DESCRIPTION OF THE EMBODIMENTS

Hereinafter, the fixing member, the method of producing the fixing member, and the fixing device according to an exemplary embodiment of the present invention will be described specifically.

(Image Forming Unit)

Figure 1:
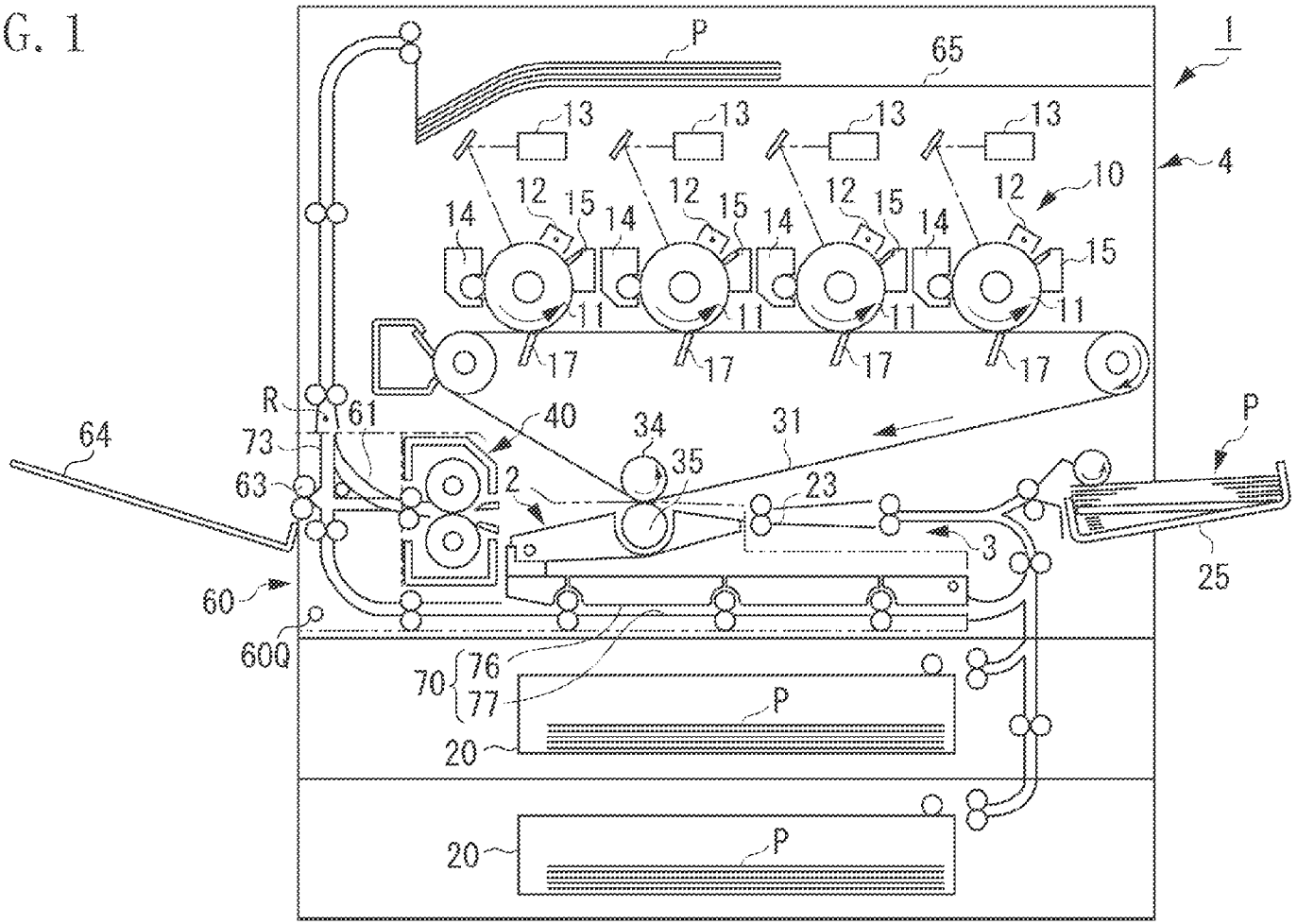
FIG. 1 is a cross-sectional view illustrating an image forming apparatus.

First, an image forming unit that forms a toner image on a sheet P (recording material) will be described. FIG. 1 is a cross-sectional view illustrating a color electrophotographic printer (hereinafter simply referred to as a printer) that is one example of image forming apparatuses, and the cross-sectional view along a feeding direction of the sheet. As described below, the sheet P is one on which the toner image is to be formed. As specific examples of the sheet, it is possible to use plain papers, sheet-shaped ones that are alternatives of the plain papers and are made from resin, thick papers, ones for overhead projectors, and the like.

The printer illustrated in FIG. 1 includes a plurality of image forming units 10 in which the toner image of each color of Y (yellow), M (magenta), C (cyan), and Bk (black) is formed. In each image forming unit, a cylindrical photosensitive drum 11, a charging device 12, a developing device 14, and a cleaning device 14 are arranged each along a circumferential direction of the photosensitive drum 11.

The toner image is formed according to the following procedure in each image forming unit. This electrophotographic image forming process is common in the respective image forming units. Thus, one image forming unit as a representative will be described.

The photosensitive drum 11 is evenly charged in a predetermined polarity (negative polarity in the present exemplary embodiment) by the charging device 12. Subsequently, an electrostatic latent image is formed according to image data to be output on the photosensitive drum 11 by a laser scanner (exposure device) 13. The electrostatic latent image formed on the photosensitive drum 11 as described above is developed using toner T (regular charging polarity is the negative polarity in the present exemplary embodiment) by the developing device 14 to make the toner image.

Subsequently, the toner image formed on the photosensitive drum 11 is transferred onto an intermediate transfer member 31 via a primary transfer member 17 to which a bias with predetermined polarity (positive polarity in the present exemplary embodiment) has been applied. After the primary transfer, residual toner left on the photosensitive drum 11 is collected by the cleaning device 15 and prepared for a subsequent image formation.

Through the above image forming process, the toner image of each color is sequentially superposed and transferred on the intermediate transfer member 31, and conveyed to a secondary transfer portion.

Meanwhile, the sheet P is sent one by one from a paper supply cassette 20 or a multiple paper supply tray 25, and fed to a registration roller pair 23. The registration roller pair 23 once stops the movement of the sheet and corrects an orientation of the sheet when the sheet is oblique. Further, the registration roller pair 23 feeds the sheet P to between the intermediate transfer member 31 and the secondary transfer member 35 in synchronization with the toner image on the intermediate transfer member 31. The full-color toner image of four colors on the intermediate transfer member 31 is secondarily transferred collectively onto the sheet P via the secondary transfer member 35 to which the predetermined polarity (positive polarity in the present exemplary embodiment) has been applied. Subsequently, the toner image formed on the sheet P is fixed on the sheet P by heating and pressurizing the sheet P in the fixing device 40.

(Fixing Device)

Figure 2:
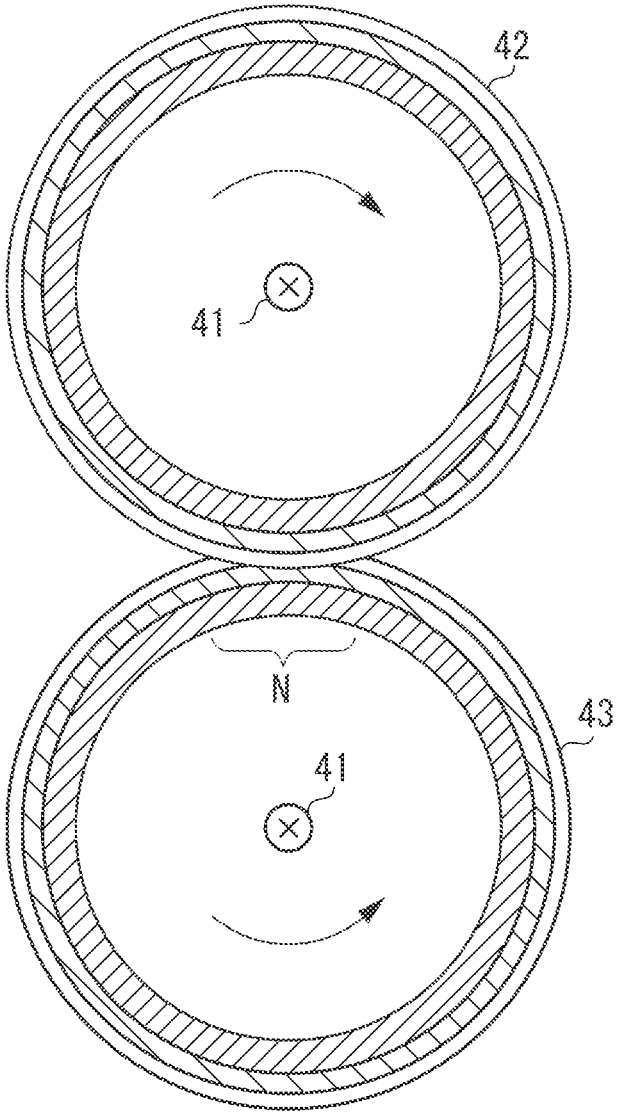
FIG. 2 is a schematic view illustrating a fixing device using a fixing roller.

Subsequently the fixing device 40 will be described. FIG. 2 is a schematic configuration diagram illustrating the fixing device 40.

The fixing device of a heat roller method composed of a pair of two rollers is used in the present exemplary embodiment. More specifically, the fixing device 40 according to the present exemplary embodiment includes a fixing roller (fixing member) 42 and a pressing roller (nip forming member) 43 pressed to the fixing roller 42. And, the unfixed toner image is fixed on the sheet P by sandwiching the sheet P with the fixing roller 42 and the pressing roller 43 in the nip portion (fixing nip portion) formed between the fixing roller 42 and the pressing roller 43 and feeding the sheet P through the nip portion.

In the present exemplary embodiment, the fixing device of the heat roller type is described as an example, but the present invention can be applied without being limited to such a configuration. It is possible to use a fixing belt in place of the fixing roller and use a pressing belt in place of the pressing roller. Further, it is also possible to replace both the fixing roller and the pressing roller with the fixing belt and the pressing belt.

A halogen heater 41 (hereinafter simply referred to as a heater) is a heating unit, and extends in a direction perpendicular to a paper plane in FIG. 2. In detail, the heater includes tungsten as a filament and an inert gas and a halogen substance are enclosed therein. The heater 41 is arranged inside the fixing roller 42 and the pressing roller 43, and held at both ends by a heater holding member (not illustrated). These heaters have a configuration controlled by a central processing unit (CPU) to keep each target temperature of the fixing roller 42 and the pressing roller 43.

Figure 3:
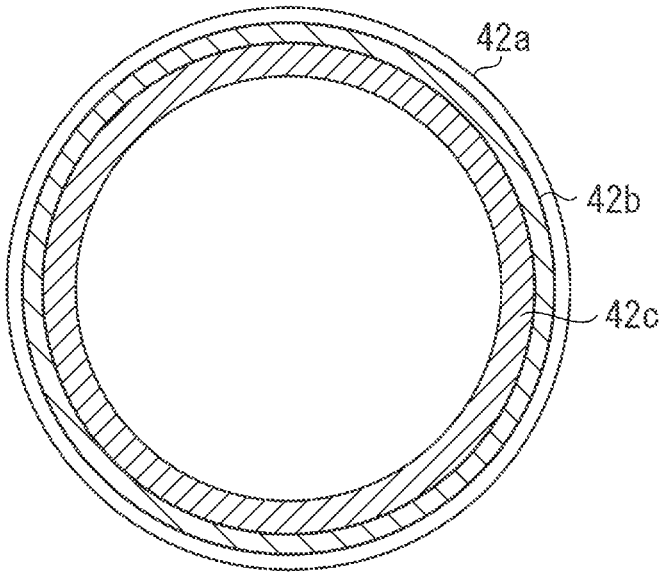
FIG. 3 is an enlarged cross-sectional view illustrating the fixing roller.

FIG. 3 is a schematic view illustrating the fixing roller (fixing member) 42. The fixing roller used in the present exemplary embodiment has a triple layer structure composed of a surface layer (toner releasing layer) 42*a*, an elastic layer 42*b*, and a metal core (base layer) 42*c* in this order from an outside to an inside in the diameter direction.

The metal core (basic layer) 42*c* is a hollow cylindrical member using a heat resistant material having a thickness of 2 mm or more so that a shape of a roller structure is not deformed with a load and can withstand the load. As the metal core 42*c*, it is preferable to use a metal material such as stainless steel (SUS) and nickel, and SUS having a thickness of 3 mm and a diameter of 60 mm was used in the present exemplary embodiment.

As the elastic layer 42*b*, it is preferable to use a rubber material, specifically silicone rubber or fluorine rubber having a thickness of 1 mm to 10 mm so as to ensure a fixing nip width utilizing deformation of the elastic layer. As the elastic layer 42*b*, the silicone rubber having a rubber hardness of 10 degrees (JIS-A), a heat conductivity of 1.3 W/m·k and a thickness of 4 mm was used in the present exemplary embodiment.

The surface layer (toner releasing layer) 42*a* is formed using a fluorine-based resin material having a thickness of 100 μm or less and preferably 20 to 70 μm as a base. As the fluorine-based resin to be the base that composes the surface layer 42*a*, it is preferable to use polytetrafluoroethylene (PTFE), tetrafluoroethylene hexafluoropropylene copolymer (FEP), or tetrafluoroethylene perfluoroalkyl vinyl ether copolymer (PFA). In the present exemplary embodiment, PFA was used as the base that composes the surface layer. Also being described later, whisker-shaped filler particles F have been added.

A method of forming the surface layer 42*a* can include a method of covering the elastic layer with a tube molded body formed cylindrically and a method of applying and burning resin on the elastic layer 42*b*. The latter method is used in the present exemplary embodiment.

The pressing roller (nip forming member, pressing member) 43 is composed of a metal core and an elastic layer composed of heat resistant rubber such as silicone rubber and fluorine rubber or a foam body of the silicone rubber. Both ends of the metal core are rotatably supported with bearings. A nip portion N with a predetermined width is formed along a sheet feeding direction by arranging the aforementioned fixing roller 42 above the pressing roller 43 and pressing the pressing roller 43 against the fixing roller via pressing force member (spring) (not illustrated). The silicone rubber having a thickness of 2 mm was used as the elastic layer and a cylindrical member having a diameter of 60 mm and composed of SUS having a thickness of 2 mm was used as the metal core in the present exemplary embodiment.

(Method of Producing Surface Layer of the Fixing Roller)

Figure 5:
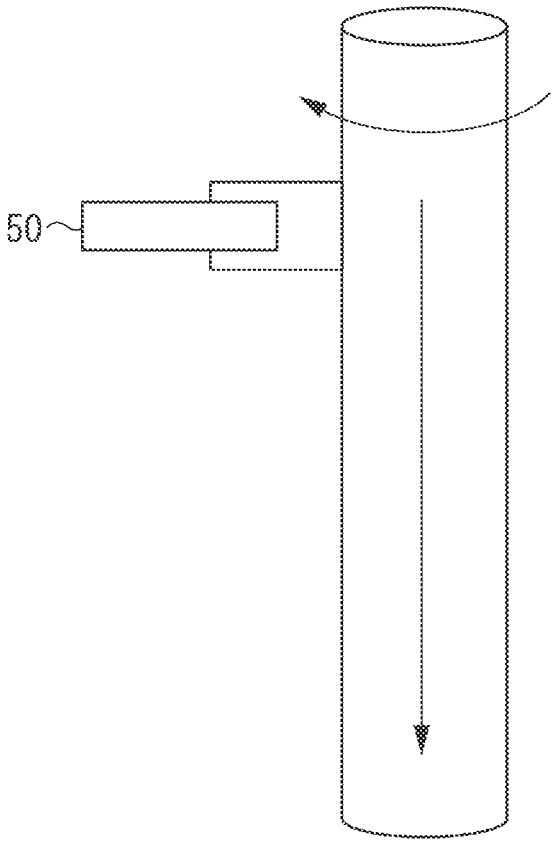
FIG. 5 is a schematic view illustrating a method of producing a surface layer by a spin-coating method.
Figure 8A:
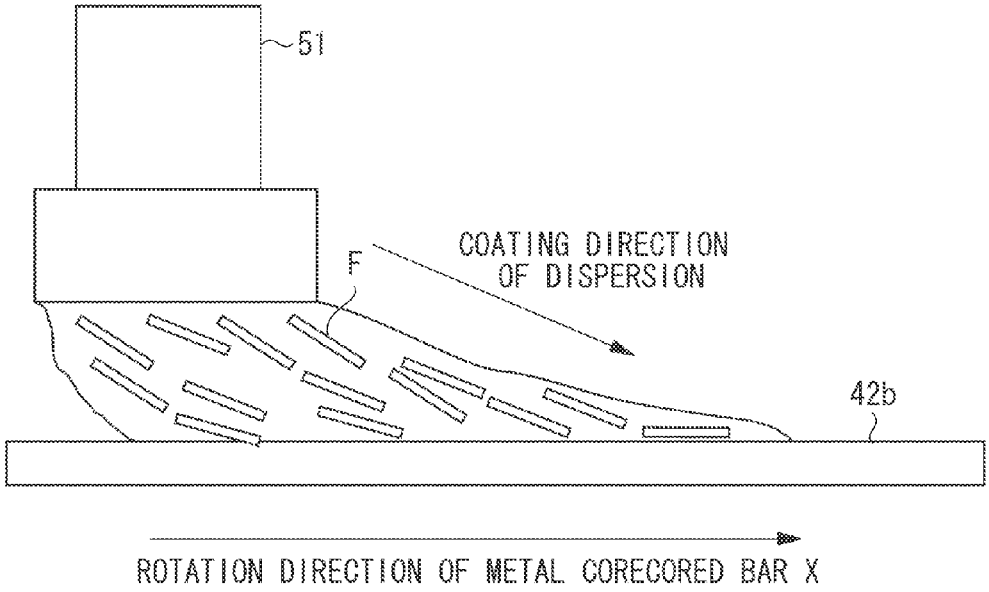
FIGS. 8A and 8B are a schematic view illustrating coating of a coating agent by a spin-coating method, and a schematic view illustrating whisker-shaped filler particles added to the surface layer, viewed from the outside of the diameter direction, respectively.
Figure 8B:
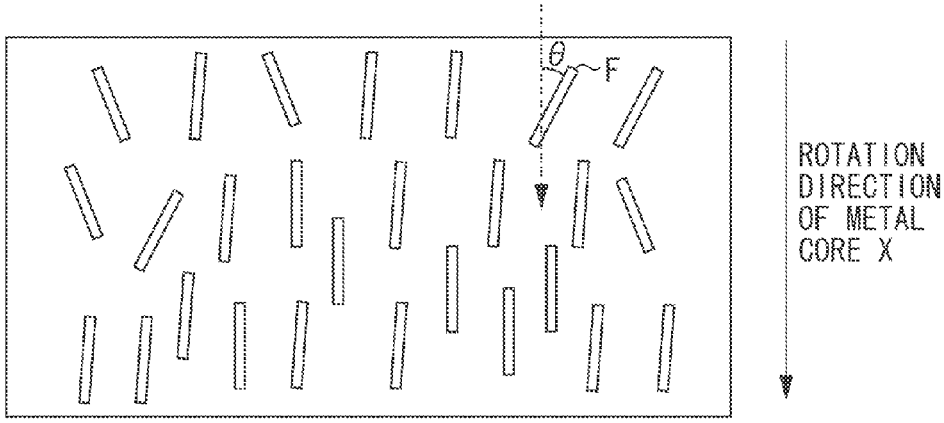

Subsequently, a method of producing the surface layer 42*a* of the fixing roller (fixing member) (method of applying and forming the surface layer) will be described with reference to FIGS. 5, 8A, and 8B. FIG. 5 is a schematic view illustrating a spin-coating method. FIG. 8A is a schematic view illustrating the coating of a coating agent on the elastic layer. FIG. 8B is a schematic view illustrating an appearance of the coating agent coated on the elastic layer (schematic view of the surface layer of the fixing roller viewed from the outside of the diameter direction). In this manner, the spin-coating method is employed in the present exemplary embodiment.

Being described below, the present exemplary embodiment is characterized in that the wisker-shaped filler particles F are added to the surface layer 42*a* so that the long axis direction thereof are aligned and oriented substantially along the rotation direction of the fixing roller, in order to enhance the toner releasing property of the surface layer 42.

First, a PFA resin dispersion in which PFA resin is dispersed in a liquid (AD_2CRE manufactured by Daikin Industries Ltd.), which is a base resin of the surface layer 42*a* is prepared. Then, the filler particles are added to and dispersed in the PFA resin dispersion to produce a coating agent.

Subsequently, the precursor of the PFA resin is coated onto the metal core on which the elastic layer has been formed using a coating agent coating mechanism 51 in which the coating agent has been housed. In the spin-coating method, the coating agent to be the surface layer is coated over the entire area in the lengthwise direction of the elastic layer by rotating the metal core on which the elastic layer has been formed and relatively moving (coming down) the metal core at a predetermined speed for the coating mechanism 51.

Subsequently, the coating agent coated onto the elastic layer 42*b* is dried and heated at 320° C. for 15 minutes to form a film. As a result, the surface layer having a thickness of 20 μm is formed.

A principle that the wisker-shaped filler particles are aligned in the rotation direction X as illustrated in FIG. 8B will be described. When the coating agent is applied while the metal core (base layer) on which the elastic layer has been formed is rotated, the filler particle having a shape anisotropy have a property that the filler particles rotate in a direction to be stabilized to a flow direction of the coating. Therefore, when the whisker-shaped filler particles have a significant large aspect ratio, the direction in which the long axis is along the flow direction of the coating is the most stable. As a result, it is thought that (the long axis direction of) the filler particles are aligned/oriented substantially along the rotation direction X of the fixing roller by coating the coating agent while the metal core on which the elastic layer has been formed is rotated.

(Concerning Type of Filler and Toner Releasing Property)

Subsequently, a type of the filler and the toner releasing property were verified. Conditions of surface layer materials used for verification experiments are summarized as illustrated in the following Table 1.

TABLE 1

| | Method of producing surface layer | Filler | Shape of filler | Particle diameter | Added amount |
|---|---|---|---|---|---|
| Comparable Example 1 | Spin coating | None | — | — | 0 wt % |
| Comparable Example 2 | Spin coating | $SiO_2$ | Spherical | 1-2 μm | 5 wt % |
| Present exemplary embodiment | Spin coating | $2Al_2O_3B_2O_3$ | Whisker | 1-2 μm | 5 wt % |

In Table 1, no filler was added in Comparative Example 1, spherical silica (particle diameter: 1 to 2 μm) as the filler particles was added in an amount of 5% by weight in Comparative Example 2, and the whisker-shaped filler particles were added in an amount of 5% by weight in present exemplary embodiment. The PFA resin was used as the base of the surface layer in all of the cases. The whisker refers to a whisker-shaped crystal, and the filler particle illustrating a whisker shape is collectively referred to as the whisker-shaped filler particle in the present exemplary embodiment. This can also be referred to as a rod-shaped filler particle.

As a material for the whisker-shaped (rod-shaped) filler particles, it is preferable to use carbon fibers, ZnO (zinc oxide), $TiO_2$ (titanium dioxide), or $2Al_2O_3.B_2O_3$ (aluminum borate). In the present exemplary embodiment, $2Al_2O_3.B_2O_3$ that had a high affinity with the PFA resin and was difficult to cause peel of the filler particles even when a fixing processing was repeatedly performed was used as the filler. A mixture of the carbon fibers, ZnO, $TiO_2$ and $2Al_2O_3.B_2O_3$ may also be used as the filler, and at least one of the carbon fibers, ZnO, $TiO_2$ and $2Al_2O_3.B_2O_3$ can be included.

The rod-shaped particles having a diameter of 1 to 2 μm, a length of 5 to 10 μm, and an aspect ratio of 5 to 10 were used as the filler. The aspect ratio refers to a ratio of a length of the lengthwise direction to a length of a short direction of the filler particle.

Figure 11A:
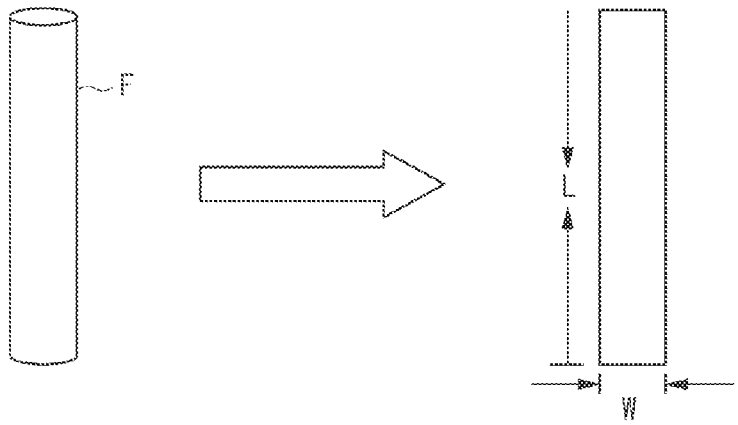
FIGS. 11A, 11B, and 11*c* are a schematic view illustrating a rod-shaped filler particle, a schematic view illustrating an elliptical shaped filler particle, and a schematic view illustrating an arc-shaped filler particle, respectively.
Figure 11B:
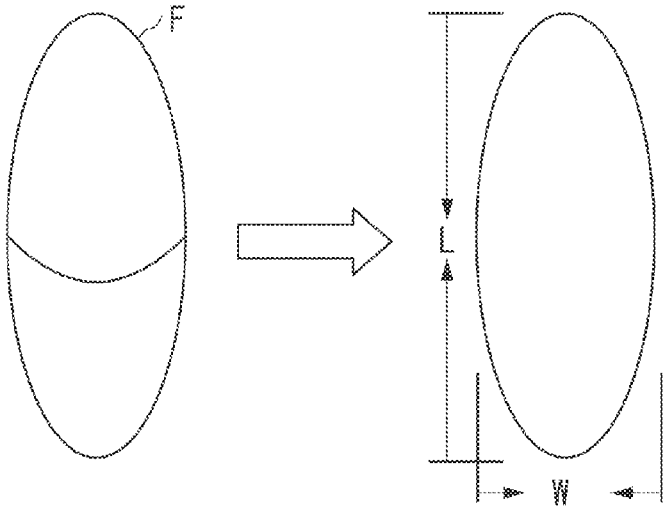
Figure 11C:
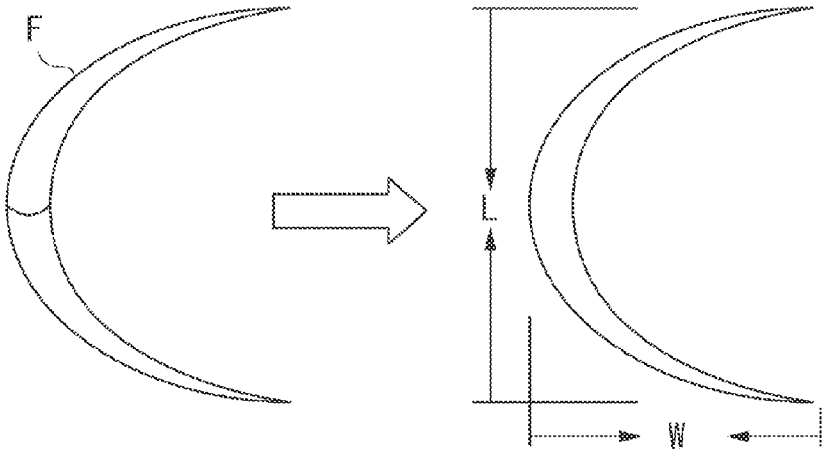

Here, the aspect ratio and a method of measuring the aspect ratio are described referring to FIG. 11. FIG. 11 is a schematic view illustrating the filler particles. In present exemplary embodiment, the aspect ratio is a ratio α of a long side L to a short side W when the filler particle is projected two-dimensionally, and is calculated by the following formula 1.

$$\alpha = L/W \quad \text{(Formula 1)}$$

For example, in the case of a rod-shaped particle as illustrated in FIG. 11A, when the particle is projected two-dimensionally, the long side is L and the short side is W. Also in the case of an elliptical shaped (rugby ball-shaped) particle as illustrated in FIG. 11B, a major axis is L and a minor axis is W when the elliptical shaped particle is projected two-dimensionally. When a particle is curved in an arch shape, a rectangle that inscribes a shape obtained when the particle is projected two-dimensionally is made, and a long side and a short side of the rectangle are L and W, respectively.

A method of evaluating the aspect ratio of the filler particles dispersed in the base resin of the surface layer material includes following methods. When a pyrolysis temperature of the filler particle is higher than that of the base resin in the surface layer, the base resin in the surface layer is sufficiently heated to a temperature at which pyrolysis occurs and burned out, and the aspect ratio can be obtained by measuring the shape of the remaining filler particles under an electron microscope. When the pyrolysis temperature of the filler particle is lower than that of the base resin in the surface layer, the fixing roller is cut (along a direction perpendicular to a rotation axis line direction) using a metal cutter to obtain its cross section. And, the aspect ratio can be obtained by measuring the shape of the filler particle in the cross section under the electron microscope.

Table 2 illustrates results of the verification experiment for the toner releasing property in each surface layer illustrated in Table 1.

TABLE 2

| | Filler | 130° C. | 140° C. | 150° C. | 160° C. | 170° C. | 180° C. | 190° C. | 200° C. |
|---|---|---|---|---|---|---|---|---|---|
| Comparative Example 1 | None | OK | OK | OK | OK | OK | NG | NG | NG |
| Comparative Example 2 | $SiO_2$ | OK | OK | NG | NG | NG | NG | NG | NG |
| Present exemplary embodiment | $2Al_2O_3B_2O_3$ | OK | OK | OK | OK | OK | OK | OK | OK |

In this verification experiment, as a fixing condition, the temperature was adjusted by 10° C. so that the temperature of the fixing roller and the pressing roller was 130 to 200° C., a pressurizing force was 100 kgf as a total pressure, and a rotation speed of the fixing roller was 200 mm/s. A sheet used is "OK Prince high quality paper" of A4 size (manufactured by Oji Paper Co., Ltd., weighing 52 g/m$^2$). A toner image of 1.2 mg/cm$^2$ was evenly formed and fixed in an entire imageable area on the sheet.

In the evaluation of the toner releasing property, a case where the sheet was appropriately separated from the fixing roller was evaluated as OK, whereas a case where the sheet twined around the fixing roller to cause a jam was evaluated as NG.

First, Comparative Example 2 in which silica was added is discussed. From Table 2, it has been found that whereas a separable temperature (highest temperature at which the sheet can be separated from the surface layer) was 170° C. in Comparative Example 1 in which no filler was added, the separable temperature dropped in Comparative Example 2 in which silica was added as the filler.

Figure 6A:
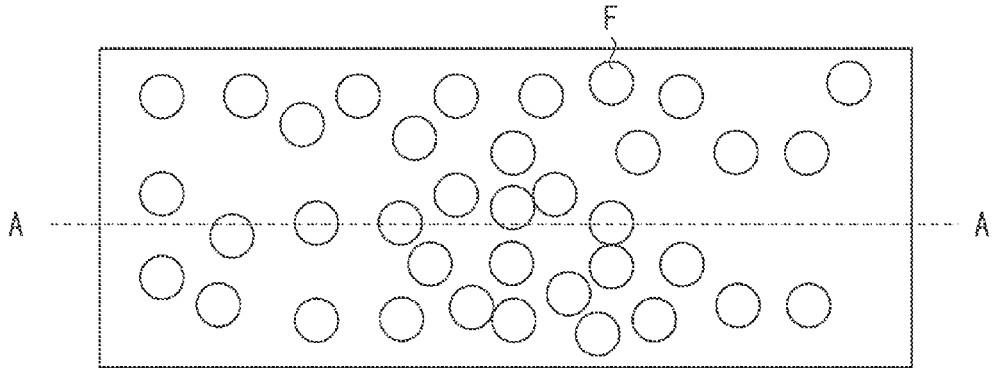
FIGS. 6A and 6B are a schematic view illustrating spherical shaped filler particles added to the surface layer, viewed from an outside of a diameter direction, and a schematic view illustrating an A-A cross-section in FIG. 6A, respectively.
Figure 6B:
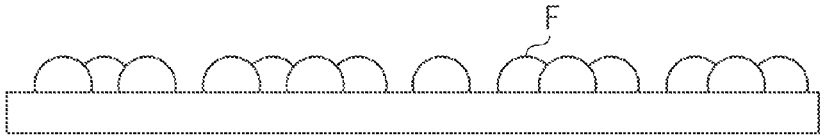

FIGS. 6A and 6B are schematic views illustrating the surface layer observed using a laser microscope (VK8700). FIGS. 6A and 6B are the schematic views illustrating Comparative Example 2, FIG. 6A is the schematic view illustrating the surface layer to which silica was added as the filler, viewed from the outside of the diameter direction, and FIG. 6B illustrates an A-A cross sectional view in FIG. 6A.

As illustrated in FIG. 6A, it can be confirmed that the filler (silica) particles are present sparsely and densely and along with this, the filler is randomly distributed in a concavoconvex state. As illustrated in FIG. 6B, the filler particles are in a dense state.

From these observation results, the reduction of the toner releasing property is considered to be associated with the following two factors.

First, surface energy of the base resin that composes the surface layer is increased by adding the filler to increase a chemical affinity with the toner. Thereby, it is considered that adhesiveness of the toner to the surface layer is increased to reduce the toner releasing property.

Second, the concavoconvex state is randomly formed on the surface, and thus, a phenomenon that the melted toner is fitted in concave portions where silica is closely packed occurs easily. If such a phenomenon occurs, a stronger force for releasing the toner is required, and thus the toner releasing property seems to be reduced.

Figure 7A:
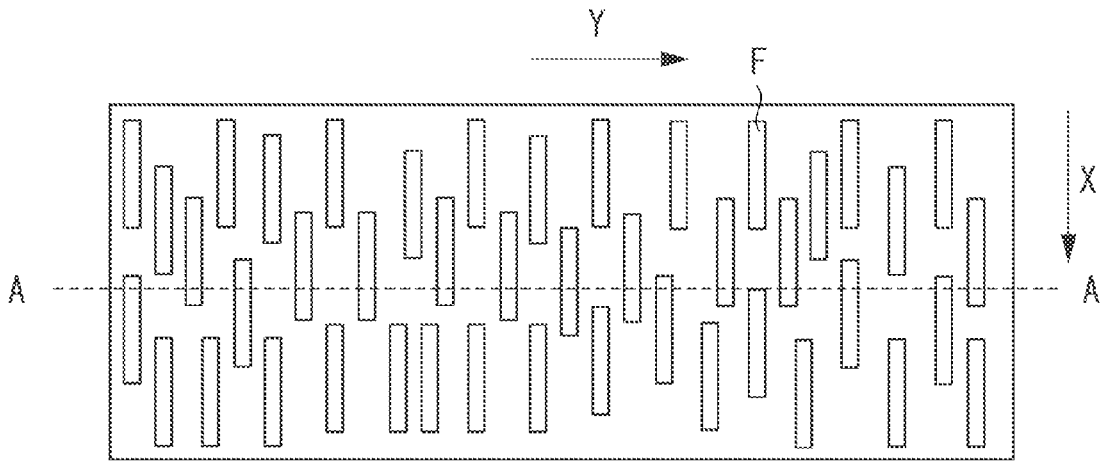
FIGS. 7A and 7B are a schematic view illustrating whisker-shaped filler particles added to the surface layer, viewed from the outside of the diameter direction, and a schematic view illustrating an A-A cross-section in FIG. 7A, respectively.
Figure 7B:
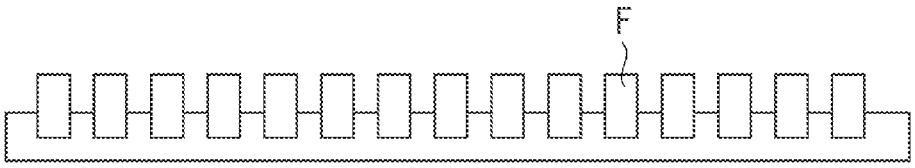

Subsequently, the case according to the present exemplary embodiment where the whisker-shaped filler particles were added is considered. FIGS. 7A and 7B are schematic views illustrating the surface layer observed using the laser microscope (VK8700) similarly to Comparative Example 2. FIG. 7A is the schematic view illustrating the surface layer viewed from the outside of the diameter direction, and FIG. 7B illustrates an A-A cross sectional view in FIG. 7A.

As illustrated in FIG. 7A and FIG. 8B, the whisker-shaped filler particles are almost uniformly aligned/oriented along a circumferential direction X (rotation direction) of the fixing roller. In this manner, anisotropy in a concavoconvex shape was observed between the rotation direction X and the rotation axis line direction Y of the fixing roller.

Subsequently, the reason why the toner releasing property is enhanced by orienting the whisker-shaped filler particles to the circumferential direction X in this way will be described referring to FIGS. 9A and 9B.

Figure 9A:
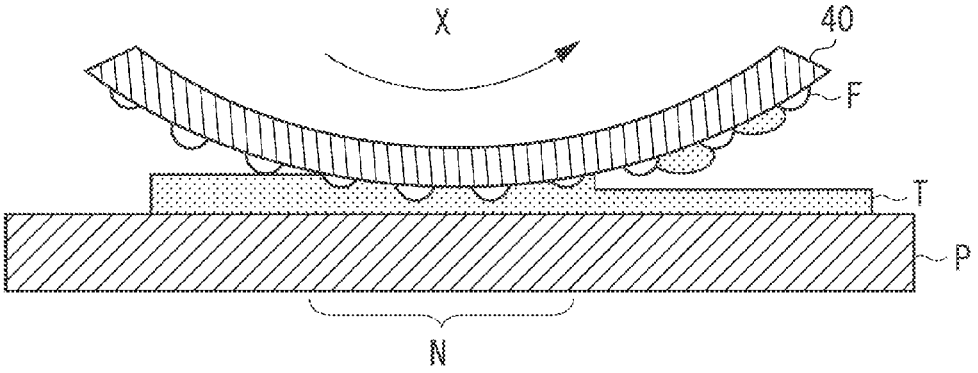
FIGS. 9A and 9B are an enlarged schematic view illustrating a fixing nip portion when the surface layer to which the spherical shaped filler particles have been added is used, and an enlarged schematic view of a fixing nip portion when the surface layer to which the whisker shaped filler particles have been added is used, respectively.

FIG. 9A is a schematic view illustrating a vicinity of the fixing nip portion when spherical shaped silica was added (Comparative Example 2). The spherical shaped silica particles have small concavoconvex intervals in the rotation direction X, thus, the toner enters airspaces formed by the filler particles F near an exit of the fixing nip portion, and anchoring of toner to the surface layer occurs easily. This seems to largely reduce the toner releasing property.

Figure 9B:
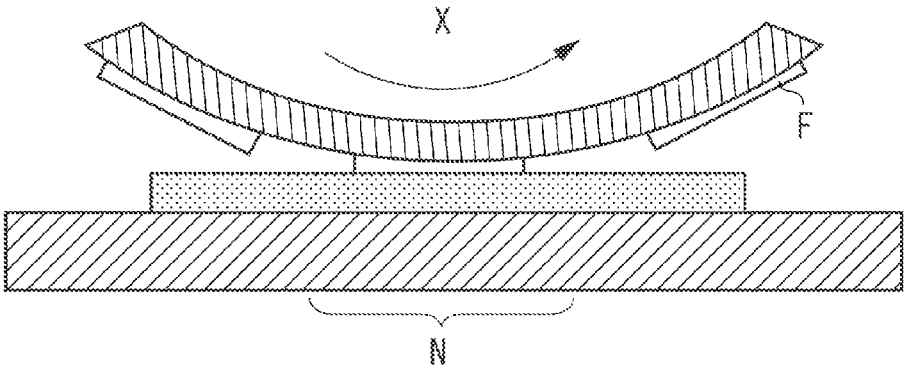

On the other hand, when the whisker-shaped filler particles are added as illustrated in FIG. 9B, the concavoconvex intervals in the rotation direction X are large, thus the phenomenon that the toner particle is fitted in the concave portions hardly occurs, and a contact area between a toner surface and the surface layer becomes small due to this concavoconvex state. Thus, it is considered that apparent toner adhesiveness is reduced to enhance the toner releasing property and increase the separable temperature (highest temperature at which the sheet can be separated from the surface layer). An effect of adding the filler to the resin that is the base that composes the surface layer is larger than a harmful effect due to an increase of the surface energy attributed to the addition of the filler. Thus, it could be confirmed that the toner releasing property was consequently enhanced.

From the above results, the surface layer having the high toner releasing property could be made by adding the whisker-shaped filler particles so that the long axis direction thereof is aligned and oriented to the rotation direction of the fixing roller.

(Coating Method of Coating Agent and Toner Releasing Property)

Subsequently, verification experiments were carried out for a coating method of the coating agent and the toner releasing property. Conditions for the surface layer materials used for the verification experiments are summarized as illustrated in the following Table 3.

Figure 4:
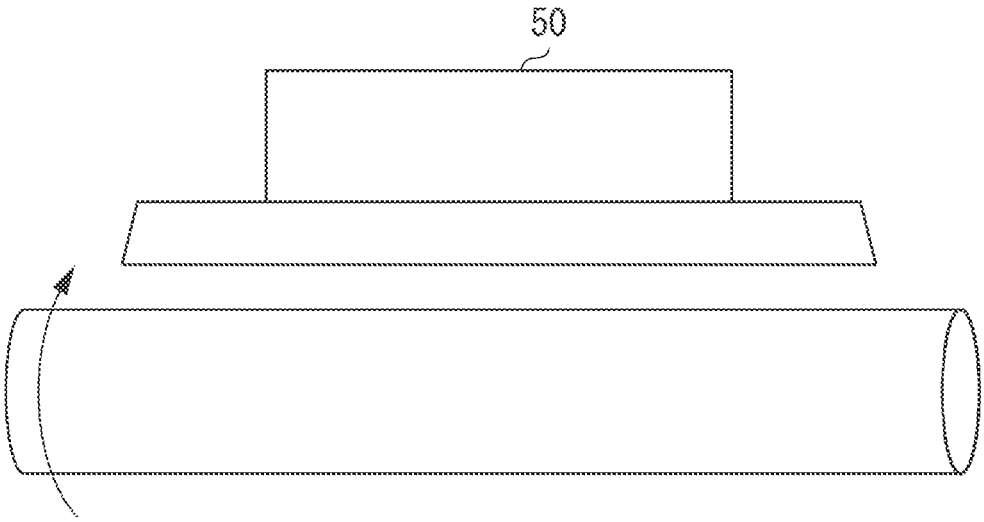
FIG. 4 is a schematic view illustrating a method of producing a surface layer by a spray coating method.

Here, in order to describe superiority of the spin-coating method employed in the present exemplary embodiment, a spray coating method is described as Comparative Example 3. FIG. 4 is a schematic view illustrating the spray coating method.

In the spray coating method, a precursor of the PFA resin is applied using a spray mechanism 50 onto the metal core on which the elastic layer has been formed, and the precursor having a desired thickness is burned to make the surface layer. The desired thickness after being burned can be controlled by controlling a concentration and a viscosity of the precursor and a thickness of the applied precursor.

TABLE 3

| | Method of producing surface layer | Filler | Shape | Particle diameter | Added amount |
|---|---|---|---|---|---|
| Comparable Example 1 | Spin coating | None | — | — | 0 wt % |
| Present exemplary embodiment | Spin coating | $2Al_2O_3B_2O_3$ | Whisker | 1-2 μm | 5 wt % |
| Comparable Example 3 | Spray coating | $2Al_2O_3B_2O_3$ | Whisker | 1-2 μm | 5 wt % |

The fixing condition and the method of determining the toner releasing property are the same as the aforementioned techniques. The results are summarized as illustrated in the following Table 4.

TABLE 4

| | Filler | Method of production | 130° C. | 140° C. | 150° C. |
|---|---|---|---|---|---|
| Comparative Example 1 | None | Spin coating | OK | OK | OK |
| Present exemplary embodiment | $2Al_2O_3B_2O_3$ | Spin coating | OK | OK | OK |
| Comparative Example 3 | $2Al_2O_3B_2O_3$ | Spray coating | OK | OK | NG |
| | 160° C. | 170° C. | 180° C. | 190° C. | 200° C. |
| Comparative Example 1 | OK | OK | NG | NG | NG |
| Present exemplary embodiment | OK | OK | OK | OK | OK |
| Comparative Example 3 | NG | NG | NG | NG | NG |

Figure 10A:
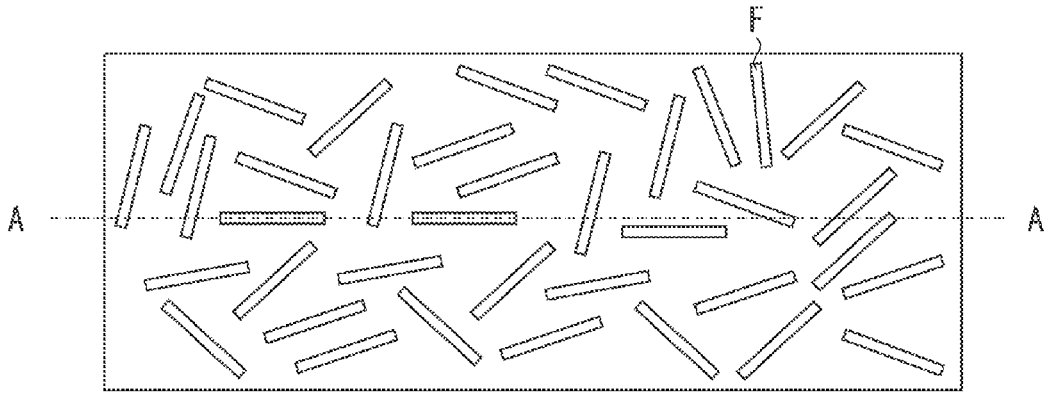
FIGS. 10A and 10B are a schematic view illustrating filler particles viewed from the outside of the diameter direction when the surface layer is produced by applying a coating agent to which the whisker-shaped filler particles have been added by the spray coating method, and a schematic view illustrating an A-A cross-section in FIG. 10A, respectively.
Figure 10B:
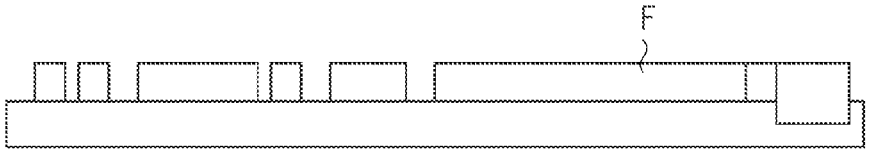

FIG. 10 is a schematic view illustrating Comparative Example 3 that was observed in the same techniques as those described in FIGS. 6 and 7. In Comparative Example 3, the whisker-shaped filler particles are added to and dispersed in the PFA dispersion, and the surface layer was made by coating the coating agent using the spray coating method. From Table 4, it has been found that the separable highest temperature in Comparative Example 3 is lower than that in Comparative Example 1 in which no filler particles were added. On the other hand, the separable highest temperature in the present exemplary embodiment that was made using the spin-coating method is higher than that in Comparative Example 1. Thus, it was confirmed that the toner releasing property was improved in the present exemplary embodiment.

From the above results, the surface layer having the high toner releasing property could be made by adding the whisker-shaped filler particles and employing the spin-coating method.

(Concerning Aspect Ratio of Filler Particle and Toner Releasing Property)

A verification experiment was carried out for a relationship between the filler shape (aspect ratio) and the toner releasing property. In this verification experiment, levels 1 to 8 were verified by changing the aspect ratio (long axis length/short axis length) of the filler particle. In this verification experiment, the rod-shaped filler particle (FIG. 11A) was used as with those described above. Roughness of the surface layer was evaluated by measuring a maximum peak height Rp (according to JIS1994) using a surface roughness meter (DSF500 manufactured by Kosaka Laboratory Ltd.). The toner releasing property was determined using the aforementioned method. The filler particle shapes examined in this experiment and experimental results are summarized as illustrated in the following Table 5.

TABLE 5

| | Filler shape | | | Experimental result | |
|---|---|---|---|---|---|
| | Diameter | Length | Aspect ratio | Rp | Separable temperature |
| Comparative Example 1 | — | — | — | 0 μm | 170° C. |
| Level 1 | 2 μm | 2 μm | 1 | 1 μm | 170° C. |
| Level 2 | 2 μm | 6 μm | 3 | 1 μm | 170° C. |
| Level 3 | 2 μm | 10 μm | 5 | 1 μm | 200° C. |
| Level 4 | 2 μm | 20 μm | 10 | 1 μm | 200° C. |
| Level 5 | 4 μm | 4 μm | 1 | 2 μm | 170° C. |
| Level 6 | 4 μm | 12 μm | 3 | 2 μm | 170° C. |
| Level 7 | 4 μm | 20 μm | 5 | 2 μm | 210° C. |
| Level 8 | 4 μm | 40 μm | 10 | 2 μm | 210° C. |

First, the aspect ratio and the toner releasing property are focused. In the present exemplary embodiment, the experiment was carried out using the rod-shaped filler particles having various aspect ratios. Specifically, the filler particles having the aspect ratio ranging from 1 to 10 were added.

When the surface layer using such a filler was observed using the laser microscope, it could be confirmed that the surface layer containing the filler particles having the aspect ratio of 5 or more exhibited the state as illustrated in FIG. 8B (the filler particles are aligned approximately in the circumferential direction). On the other hand, it could be confirmed that the surface layer containing the filler having the aspect ratio of 3 or less exhibited the state as illustrated in FIG. 10A (the filler particles are aligned randomly).

Here, an orientation property (degree of orientation) of the filler particles in each aspect ratio is described using an orientation rate. The orientation rate A in this verification experiment was calculated by a following formula 2 when 50 filler particles were observed using an optical microscope and the number of particles satisfying $-30° \leq \theta \leq 30°$ where an angle θ was made by the long axis direction of the filler particle and the rotation direction X of the fixing roller is N (see FIG. 8B):

$$A=(N/50)\times 100(\%) \quad \text{(Formula 2)}$$

As a result, the orientation rate was 75% in the filler having the aspect ratio of 5 or more and 50% or less in the filler having the aspect ratio of 3 or less. Therefore, it is found that the orientation property (degree of orientation) of the filler particle depends on the aspect ratio. Accordingly, it is found that it is better to include the filler particles having the aspect ratio of 5 or more and oriented within ±30° against the rotation direction X of the fixing roller in an amount of 75% or more among the filler particles added to the surface layer. When such a condition is satisfied, the toner releasing property can be enhanced.

Subsequently, focusing on the condition in which the maximum peak height Rp satisfies Rp≥2 μm (levels 5 to 8), the relationship between the aspect ratio and the toner releasing property is considered. The separable temperature (highest temperature at which the sheet can be separated from the surface layer) was further increased and the toner releasing property was enhanced in the conditions where the aspect ratio is 5 to 10, while in the aspect ratio of 1 to 3, the toner releasing property was equivalent to that in Comparative Example 1 (no filler was added).

When the filler particle has the small aspect ratio, a rotation force of the filler against an coating flow is weakened, and easiness to align the particles depending on a direction of the coating flow as illustrated in FIG. 8A is reduced. Thus, the filler particles are aligned randomly. This makes it impossible to enhance the toner releasing property. Therefore, in order to enhance the toner releasing property by aligning the filler particles, it is preferable to make the aspect ratio 5 or more.

Next, the condition of adding the filler particles having the aspect ratio of 5 to 10 is focused concerning the maximum peak height Rp and the separable temperature (the highest temperature at which the sheet can be separated from the surface layer) as well as image formation. Under the condition where the maximum peak height satisfies Rp≥1 μm, the separable temperature (the highest temperature at which the sheet can be separated from the surface layer) rose, and it could be confirmed that the toner releasing property was improved.

(Concerning Durability of Surface Layer)

A verification experiment was carried out for durability of the surface layer. In this verification experiment, a roughening treatment with a wrapping film was given to the surface layer in Comparative Example 4 so that this surface layer has the same surface roughness as that in present exemplary embodiment. The methods of determining the fixing condition and the separable temperature (the highest temperature at which the sheet can be separated from the surface layer) were the same as above. Also in this verification experiment, in order to verify whether the roughness of the surface layer was kept or not over a long period of time, the sheets on which no toner image was formed (aforementioned OK Prince high quality papers) as many as illustrated in Table 6 were continuously passed through the fixing nip portion. Subsequently, the unfixed toner image was formed in an imageable area on the sheet (OK Prince high quality paper) as described above, and then a separative property of the sheet (toner releasing property) was determined when the fixing processing was performed. The results of this verification experiment are summarized as illustrated in the following Table 6.

TABLE 6

| | Filler | Treatment | 100,000 sheets | 200,000 sheets |
|---|---|---|---|---|
| Comparative Example 1 | None | None | 170° C. | 170° C. |
| Comparative Example 4 | None | Roughening treatment | 200° C. | 185° C. |
| Present exemplary embodiment | $2Al_2O_3B_2O_3$ | Spin coating | 200° C. | 200° C. |

TABLE 6-continued

| | 300,000 sheets | 400,000 sheets | 500,000 sheets |
|---|---|---|---|
| Comparative Example 1 | 170° C. | 170° C. | 170° C. |
| Comparative Example 4 | 170° C. | 170° C. | 170° C. |
| Present exemplary embodiment | 200° C. | 200° C. | 200° C. |

In Comparative Example 4, the surface layer had the maximum peak height Rp of 1 μm by giving the roughening treatment using the wrapping film, and thus the high toner releasing property was obtained without dropping the separable temperature at a stage up to 100,000 sheets. However, the separable temperature dropped at a stage of 200,000 sheets and dropped to the same level as that in Comparative Example 1 at a stage of 300,000 sheets (Rp=0.3 μm).

On the other hand, in the configuration of the present exemplary embodiment, even when the surface layer was ground down due to passage of the sheets, a new filler in the surface layer is exposed. Thus, the initial concavoconvex state (Rp=1 μm) was kept at the stage of 500,000 sheets, and the toner releasing property could be kept in the use over a long period of time.

From the above results, according to the configuration of present Example, it is possible to provide the surface layer of the fixing member having the high toner releasing property over a long period of time.

Subsequently, a second exemplary embodiment will be described. In the first exemplary embodiment described above, in terms of enhancing the toner releasing property on the surface layer of the fixing roller (fixing member), it has been found that the whisker-shaped filler particles are aligned/oriented in the surface layer to nearly follow the rotation direction of the fixing roller. In present exemplary embodiment, the investigation was carried out in terms of "output image quality" in addition to the viewpoint found in the first exemplary embodiment.

Specifically, a verification experiment was carried out for a relationship between the roughness of the surface layer and the output image quality. In this verification experiment, the rod-shaped filler (aspect ratio of 5) illustrated in FIG. 11A was used, as well as the surface layer of the fixing member was made by the spin-coating method in the same manner as in The first exemplary embodiment. Also in this verification experiment, levels 13 to 16 were verified with changing the aspect ratio (long axis length/short axis length) of the filler.

The roughness of the surface layer of the fixing roller was evaluated by measuring the maximum peak height Rp using the surface roughness meter (DSF500 manufactured by Kosaka Laboratory Ltd.) (according to JI51994) in the same manner as in The first exemplary embodiment. The separable temperature (the highest temperature at which the sheet can be separated from the surface layer of the fixing member) was determined in the same manner as in The first exemplary embodiment. Concerning the output image quality, a fault (gloss unevenness of an image) on an output image after the fixing processing was checked visually. Then, a case of no fault was evaluated as OK and a case of having the fault was evaluated as NG. The filler particle shapes examined in this verification experiment and experimental results are summarized as illustrated in the following Table 7.

TABLE 7

| | Filler shape | | | Experimental results | | |
|---|---|---|---|---|---|---|
| | Diameter | Length | Aspect ratio | Rp μm | Separable temperature | Quality of output image |
| Comparative Example 1 | — | — | — | 0 | 170° C. | OK |
| Level 13 | 2 μm | 10 μm | 5 | 1 | 200° C. | OK |
| Level 14 | 4 μm | 20 μm | 5 | 2 | 210° C. | OK |
| Level 15 | 6 μm | 30 μm | 5 | 3 | 210° C. | OK |
| Level 16 | 8 μm | 40 μm | 5 | 4 | 210° C. | NG |

From these results, a quality loss (occurrence of the fault) was observed on the output image after the fixing processing when the maximum peak height satisfies Rp≥4 μm. Therefore, it is found that it is preferable that the maximum peak height Rp is in the range of 1 μm≤Rp≤3 μm while the condition where the aspect ratio is 5 or more as described in the first exemplary embodiment is satisfied. Therefore, by employing the configuration of the present exemplary embodiment, the satisfied level of the separable temperature (the highest temperature at which the sheet can be separated from the surface layer) can be obtained, as well as the satisfied level of the quality for the output image can be obtained.

As described above, by aligning/orienting the whisker-shaped filler particles in the surface layer to nearly follow the rotation direction of the fixing roller as well as satisfying the maximum peak height of 1 μm≤Rp≤3 μm on the surface layer, it is possible to prevent the quality loss of the output image compared with the configuration of the first exemplary embodiment.

Figure 12:
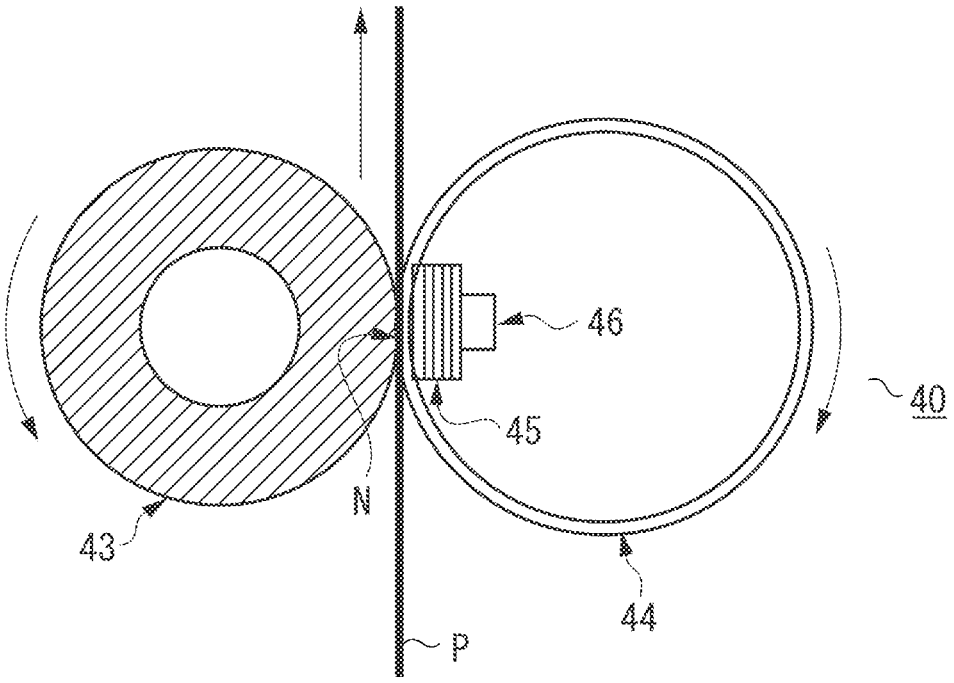
FIG. 12 is a cross-sectional view illustrating a fixing device using a fixing belt.
Figure 13:
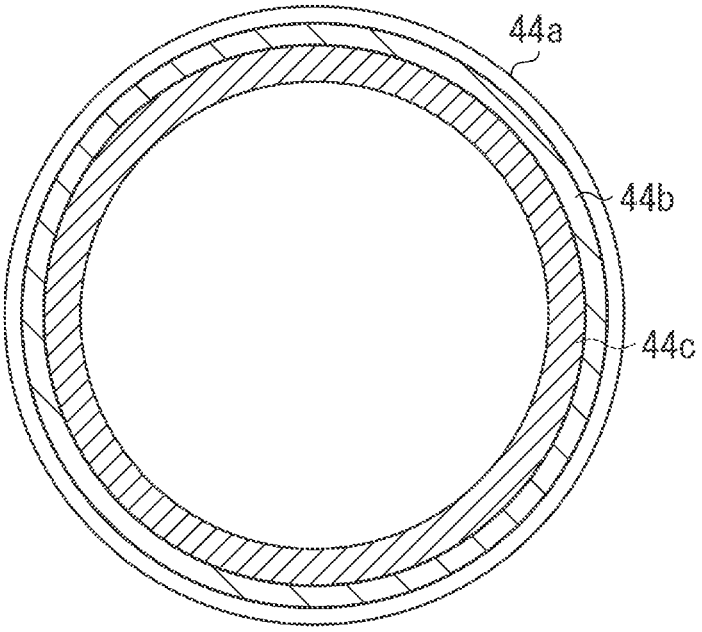
FIG. 13 is an enlarged cross-sectional view illustrating the fixing belt.

A third exemplary embodiment will be described referring to FIGS. 12 and 13. FIG. 12 is a cross-sectional view illustrating the fixing device, and FIG. 13 is a cross-sectional view illustrating the fixing belt. The description of the portions, which are overlapped with the descriptions in the first exemplary embodiment will be omitted by giving the same signs to the portions. The present exemplary embodiment is largely different from the first exemplary embodiment in that the present invention is applied to the fixing device employing a tensionless belt system.

As illustrated in FIG. 12, the fixing device of the present exemplary embodiment is composed of a pressing roller (pressing member, nip forming member) 43, a fixing belt (fixing member) 44, a ceramic heater 45, and a thermistor 46 that detects the temperature of the ceramic heater. Specifically, the fixing belt 44 is driven and rotated with the pressing roller 43.

As illustrated in FIG. 13, the fixing belt 44 is an endless fixing belt having a triple layer complex structure composed of a surface layer 44*a*, an elastic layer 44*b*, and a basic layer 44*c*. It is preferable to use a fluorine-based material having a thickness of 100 μm or less and preferably 20 to 70 μm for the surface layer 44*a*. In the present exemplary embodiment, the same PFA resin having a thickness of 20 μm as in the present exemplary embodiment is used as the base of the surface layer. This surface layer 44 is produced in the same manner as in the first exemplary embodiment and has the same configuration as in the first exemplary embodiment. That is, the whisker-shaped filler is added. In a majority of the filler particles among the filler particles added to the surface layer, their long axis direction is aligned/oriented nearly along the rotation direction of the fixing belt.

In the elastic layer 44*b*, it is preferable to use a rubber material, specifically silicone rubber or fluorine rubber having a thickness of 1000 μm or less and preferably 500 μm or less in order to reduce a heat capacity and enhance a quick starting property. The silicone rubber having a rubber strength of 10 degrees (JIS-A), a heat conductivity of 1.3 W/m·k and a thickness of 300 μm was used in the present exemplary embodiment.

The basic layer 44*c* is a metal layer. In order to enhance the quick starting property as with the elastic layer 44*b*, it is preferable to use a heat resistant material, specifically SUS or nickel having a thickness of 100 μm or less and preferably 50 μm or less and 20 μm or more for the basic layer. In the present exemplary embodiment, a cylindrical nickel metal film having a thickness of 30 μm and a diameter of 25 mm was used.

Also in the fixing device using the fixing belt 44 according to the present exemplary embodiment, it is possible to enhance the toner releasing property as is with the first exemplary embodiment.

The configuration of the present exemplary embodiment may also satisfy the configuration of the second exemplary embodiment, i.e., that the maximum peak height Rp on the surface layer of the fixing belt 44 is 1 μm≤Rp≤3 μm. In that case, it is possible to prevent the quality loss of the output image.

As described above, the present invention has been specifically described with reference to the first exemplary embodiment, second exemplary embodiment, and the third exemplary embodiment, and it is also possible to replace various configurations with known configurations within the scope of the thought of the present invention.

Also in the first to third exemplary embodiments described above, the fixing member typified by the fixing roller or the fixing belt has been described to have the triple layer structure composed of the basic layer, the elastic layer, and the surface layer, but, for example, the elastic layer may be omitted and the surface layer may be formed directly on the basic layer.

Further in the first to third exemplary embodiments described above, the configuration in which the whisker-shaped filler is added to the surface layer of the fixing member typified by the fixing roller or the fixing belt has been described, but the configuration is not limited to such a configuration. For example, the same configuration in which the wisker-shaped filler is added to the surface layer may also be applied to the pressing roller and the pressing belt. In this case, the pressing roller and the pressing belt would work as the fixing member according to the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-263252, filed Nov. 30, 2012, which is hereby incorporated by reference herein in its entirety.

What is claimed is:

1. A fixing member comprising a base layer; and a surface layer provided on the base layer, wherein filler particles are added to the surface layer and 75% or more of the filler particles have an aspect ratio of 5 or more and are oriented to be within ±30° with respect to a rotation direction of the fixing member.

2. The fixing member according to claim 1, wherein Rp satisfies 1 μm≤Rp≤3 μm where a maximum peak height of the surface layer is represented by Rp.

3. The fixing member according to claim 1, further comprising an elastic layer between the base layer and the surface layer.

4. The fixing member according to claim 1, wherein a base of the surface layer is composed of fluorine-based resin, and wherein at least one of carbon fibers, ZnO, $TiO_2$ and $2Al_2O_3.B_2O_3$ as the filler having an aspect ratio of 5 or more is added to the surface layer.

5. The fixing member according to claim 1, wherein a base of the surface layer is composed of PFA resin, and wherein $2Al_2O_3.B_2O_3$ having an aspect ratio of 5 or more is added to the surface layer as the filler.

6. A fixing device comprising a fixing member including a base layer and a surface layer provided on the base layer and configured to fix a toner image formed on a sheet; and a heater configured to heat the fixing member, wherein filler particles are added to the surface layer and 75% or more of the filler particles have an aspect ratio of 5 or more and are oriented to be within ±30° with respect to a rotation direction of the fixing member.

7. The fixing device according to claim 6, wherein Rp satisfies 1 μm≤Rp≤3 μm where a maximum peak height of the surface layer is represented by Rp.

8. The fixing device according to claim 6, further comprising an elastic layer between the base layer and the surface layer.

9. The fixing device according to claim 6, wherein a base of the surface layer is composed of fluorine-based resin, and wherein at least one of carbon fibers, ZnO, $TiO_2$ and $2Al_2O_3.B_2O_3$ having an aspect ratio of 5 or more is added to the surface layer as the filler.

10. The fixing device according to claim 6, wherein a base of the surface layer is composed of PFA resin, and wherein $2Al_2O_3.B_2O_3$ having an aspect ratio of 5 or more is added to the surface layer as the filler.

11. A method of producing a fixing member comprising:

adding filler particles having an aspect ratio of 5 or more to fluorine-based resin that is a base of the fixing member; and coating the resin to which the filler particles are added onto a base layer while the base layer configuring the fixing member is rotated.

12. The method according to claim 11, wherein the base layer is relatively moved to a rotation axis line direction relative to a coating mechanism that coats the resin to which the filler particles are when coating the resin on the base layer.

13. The method according to claim 11, further comprising forming an elastic layer on the base layer, wherein the surface layer is formed on the elastic layer.

14. The method according to claim 11, wherein at least one of carbon fibers, ZnO, $TiO_2$ and $2Al_2O_3.B_2O_3$ is added as the filler particles as filler particles.

15. The method according to claim 11, wherein the fluorine-based resin is PFA resin and the filler is $2Al_2O_3.B_2O_3$.

* * * * *